US008672569B2

(12) United States Patent
Yada et al.

(10) Patent No.: US 8,672,569 B2
(45) Date of Patent: Mar. 18, 2014

(54) PLATEN ROLLER FIXING STRUCTURE AND PRINTER

(75) Inventors: Yuji Yada, Tokyo (JP); Kunihiko Funada, Tokyo (JP); Yukihiro Mori, Tokyo (JP)

(73) Assignee: Fujitsu Components Limited, Tokyo (JP)

( * ) Notice: Subject to any disclaimer, the term of this patent is extended or adjusted under 35 U.S.C. 154(b) by 218 days.

(21) Appl. No.: 13/437,078

(22) Filed: Apr. 2, 2012

(65) Prior Publication Data

US 2012/0266769 A1 Oct. 25, 2012

(30) Foreign Application Priority Data

Apr. 20, 2011 (JP) ..... 2011-094339

(51) Int. Cl.
*B41J 11/04* (2006.01)

(52) U.S. Cl.
USPC ..... 400/649; 400/693; 347/220

(58) Field of Classification Search
USPC ..... 101/649
See application file for complete search history.

(56) References Cited

U.S. PATENT DOCUMENTS

| | | | | |
|---|---|---|---|---|
| 4,984,916 | A * | 1/1991 | Sekine et al. | 400/613.1 |
| 5,188,029 | A * | 2/1993 | Sugimoto et al. | 101/288 |
| 5,360,278 | A * | 11/1994 | Fukahori et al. | 400/120.01 |
| 6,004,053 | A * | 12/1999 | Petteruti et al. | 400/693 |
| 6,443,645 | B1 * | 9/2002 | Takei et al. | 400/621 |
| 6,491,459 | B2 * | 12/2002 | Hosomi | 400/613 |
| 2004/0096256 | A1 | 5/2004 | Hayashi et al. | |

FOREIGN PATENT DOCUMENTS

JP 2004-098625 4/2004

* cited by examiner

*Primary Examiner* — Jill Culler
(74) *Attorney, Agent, or Firm* — IPUSA, PLLC

(57) ABSTRACT

A platen roller fixing structure includes a platen roller; a spring; a spring supporting part supporting the spring; a print head; a platen roller receiving part configured to receive the platen roller; and a spring receiving part configured to receive the spring. The platen roller, the spring, and the spring supporting part are provided on one of a body part and a movable part of a printer. The movable part is rotatably connected to the body part. The print head, the platen roller receiving part, and the spring receiving part are provided on the other one of the body part and the movable part. When the movable part is closed relative to the body part, the spring receiving part comes into contact with the spring to cause the spring to press the platen roller against the platen roller receiving part.

10 Claims, 6 Drawing Sheets

PLATEN ROLLER FIXING STRUCTURE AND PRINTER

CROSS-REFERENCE TO RELATED APPLICATION

The present application is based upon and claims the benefit of priority of Japanese Patent Application No. 2011-094339, filed on Apr. 20, 2011, the entire contents of which are incorporated herein by reference.

BACKGROUND OF THE INVENTION

1. Field of the Invention

The present invention relates to a platen roller fixing structure and a printer including the platen roller fixing structure.

2. Description of the Related Art

A printer that feeds a printing medium on which printing is to be performed, performs printing on the printing medium, and cuts the printing medium after printing is illustrated in, for example, Japanese Laid-Open Patent Application No. 2004-98625. However, Japanese Laid-Open Patent Application No. 2004-98625 discloses no fixing structure for fixing a platen roller used for feeding the printing medium to a predetermined position relative to a print head.

Here, such a fixing structure is included in a printer 51 as illustrated in FIG. 1. In the printer 51, a platen roller 52 and a print head 53 form a printing part. The platen roller 52 is disposed on a paper holder cover 56, which is a movable part connected via a hinge 55 to a main frame 54, which is a body part. The print head 53, a platen roller receiving part 57, and a platen roller fixing spring 58 are disposed on the main frame 54.

Referring to FIG. 1, the printer 51 accommodates a roll R of a printing medium P such as paper. The printer 51 includes a battery B, which serves as a power supply for the printer 51. The printer 51 further includes a paper holder cover lock 59. The paper holder cover lock 59 holds an end portion of the paper holder cover 56 from the exterior side after the paper holder cover 56 is moved from an open position indicated by a broken line to a closed position indicated by a solid line.

FIG. 1 illustrates a cross section of the printer 51 perpendicular to the center axis line of the platen roller 52 and including the platen roller receiving part 57. In this cross section, the platen roller fixing spring 58 has an L-letter shape and has its long-side portion fixed to the main frame 54 using an appropriate technique such as screwing, bonding, insert molding, or the like.

The short-side portion of the platen roller fixing spring 58 is inclined in an inward direction relative to and toward the circumferential clockwise approach path of the platen roller 52 at the time of closing the paper holder cover 56. Further, the long-side portion of the platen roller fixing spring 58 is inclined in an inward direction relative to and toward the circumferential counterclockwise leaving path of the platen roller 52 at the time of opening the paper holder cover 56.

In this printer 51, after the platen roller 52 is housed in the platen roller receiving part 57 after the paper holder cover 56 is closed, the long-side portion of the platen roller fixing spring 58 holds and fixes the platen roller 52 to the platen roller receiving part 57 with the elastic force of the platen roller fixing spring 58, unless an operating force greater than or equal to a certain magnitude is exerted on the leaving path side.

SUMMARY OF THE INVENTION

According to an aspect of the invention, a platen roller fixing structure includes a platen roller; a spring; a spring supporting part supporting the spring; a print head; a platen roller receiving part configured to receive the platen roller; and a spring receiving part configured to receive the spring, wherein the platen roller, the spring, and the spring supporting part are provided on one of a body part and a movable part of a printer, the movable part being rotatably connected to the body part, the print head, the platen roller receiving part, and the spring receiving part are provided on another one of the body part and the movable part, and when the movable part is closed relative to the body part, the spring receiving part comes into contact with the spring to cause the spring to press the platen roller against the platen roller receiving part.

According to an aspect of the invention, a printer includes a body part; a movable part rotatably connected to the body part; and a platen roller fixing structure, the platen roller fixing structure including a platen roller; a spring; a spring supporting part supporting the spring; a print head; a platen roller receiving part configured to receive the platen roller; and a spring receiving part configured to receive the spring, wherein the platen roller, the spring, and the spring supporting part are provided on one of the body part and the movable part, the print head, the platen roller receiving part, and the spring receiving part are provided on another one of the body part and the movable part, and when the movable part is closed relative to the body part, the spring receiving part comes into contact with the spring to cause the spring to press the platen roller against the platen roller receiving part.

The object and advantages of the embodiment will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENT

Figure 1:
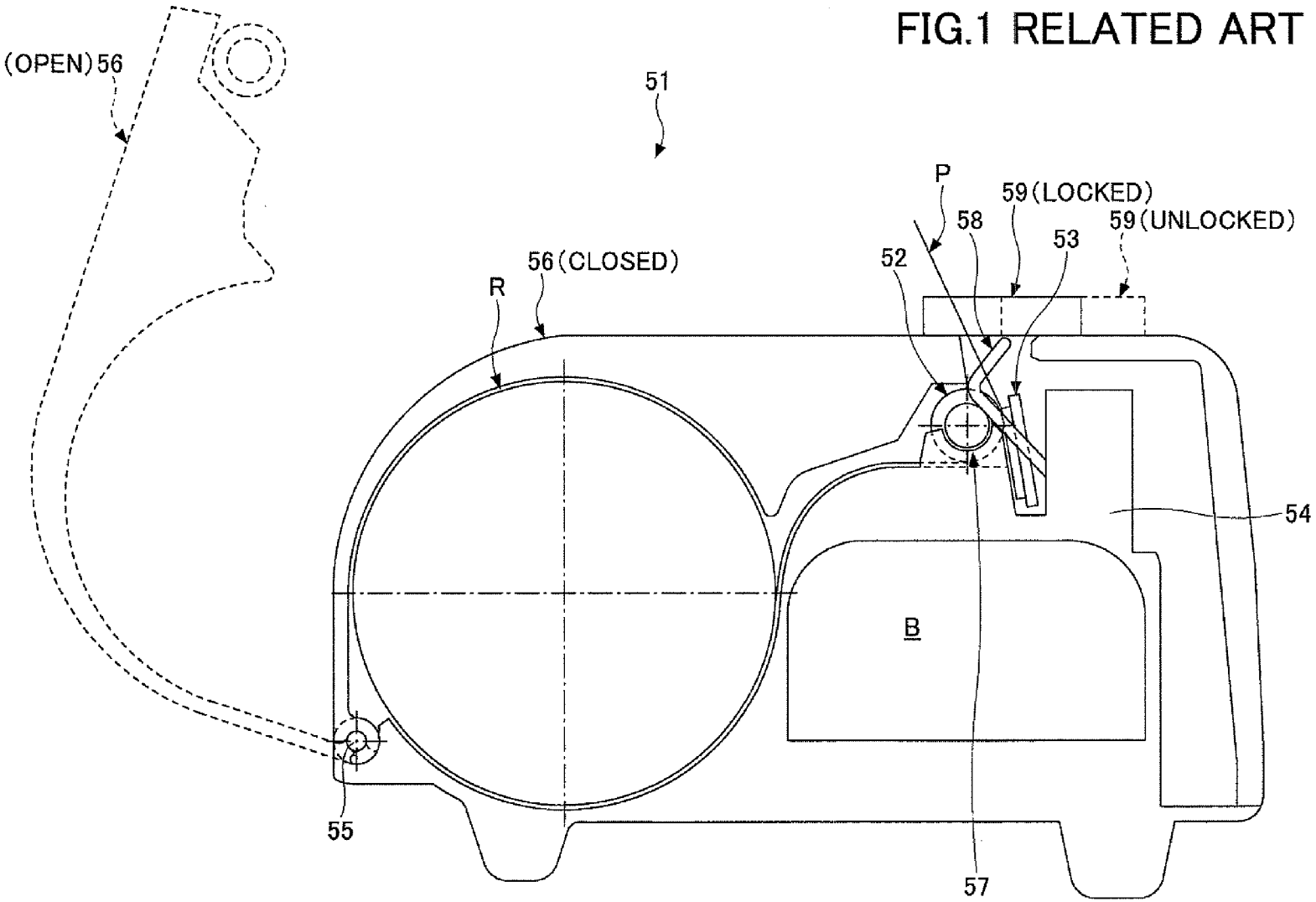
FIG.1 RELATED ART
FIG. 1 is a schematic diagram illustrating a platen roller fixing structure in a conventional printer.

In the above-described printer 51, however, if the elastic force of the platen roller fixing spring 58 is increased in order to increase the force of the platen roller fixing spring 58 for fixing or holding the platen roller 52 to the platen roller receiving part 57, an operating force for causing the platen roller 52 to contact and push aside the short-side portion of the platen roller fixing spring 58 at the time of closing the paper holder cover 56 also increases. This causes the problem of a decrease in operability at the time of closing the paper holder cover 56.

According to an aspect of the present invention, a platen roller fixing structure and a printer are provided that make it possible to increase a force for fixing a platen roller without reducing closing-time operability.

A description is given below, with reference to the accompanying drawings, of an embodiment of the present invention.

Figure 2:
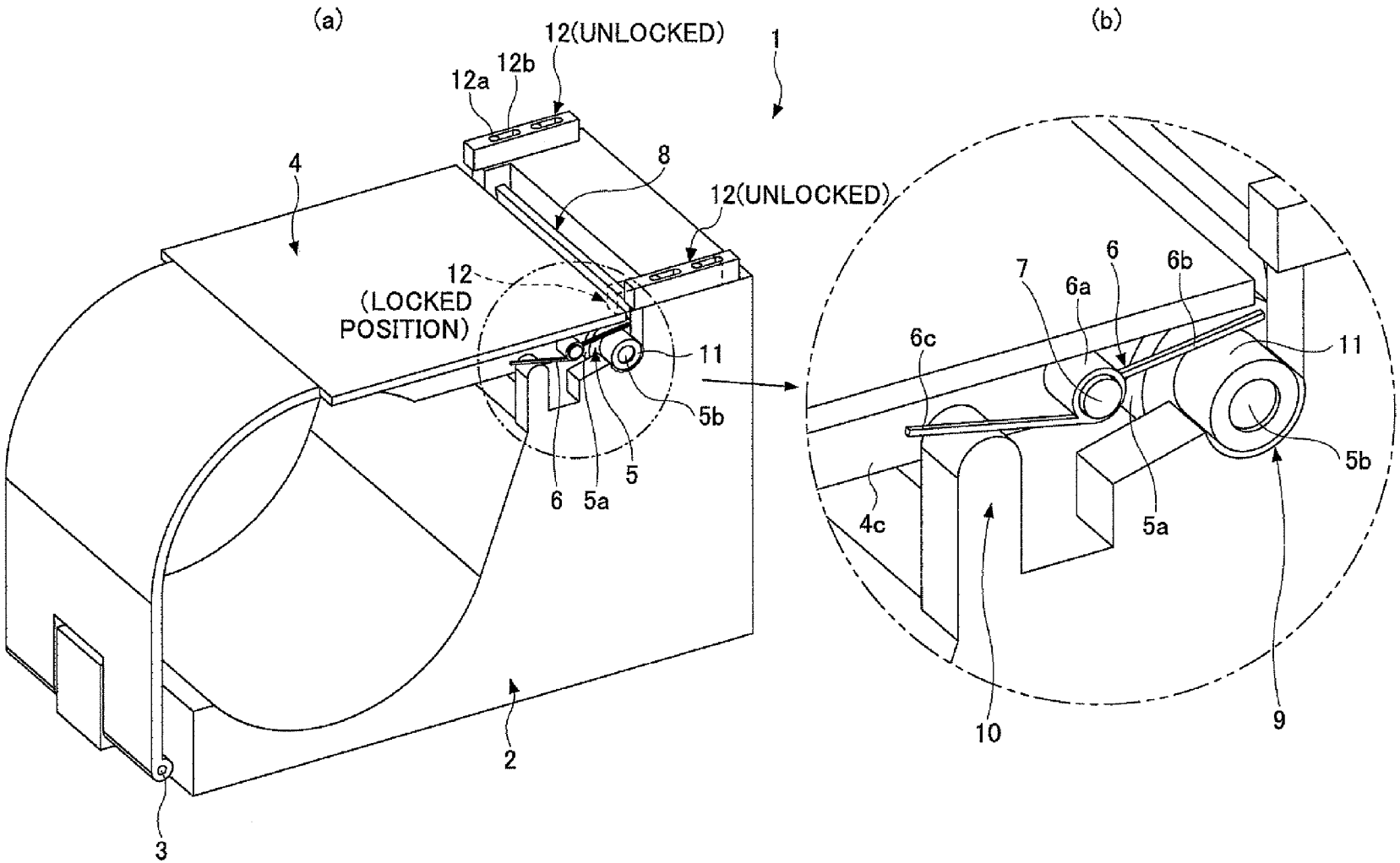
FIG. 2 is a schematic diagram illustrating a platen roller fixing structure and a printer according to an embodiment.

FIG. 2 is a diagram illustrating a printer 1 including a platen roller fixing structure according to the embodiment. In FIG. 2, (a) is a schematic perspective view of the printer 1, and (b) is an enlarged view of part of the printer 1 encircled with a two-dot chain line.

Referring to FIG. 2, the printer 1 of this embodiment includes a main frame 2 (a body part), a medium holder cover 4 (a movable part) rotatably connected to the main frame 2 via a hinge 3, a platen roller 5 for feeding a printing medium, platen roller fixing springs 6, spring supporting parts 7, a print head 8, a platen roller receiving part 9, and a spring receiving part 10.

The platen roller fixing springs 6 are movably (for example, swingably) supported by the respective spring supporting parts 7. The platen roller 5, the platen roller fixing springs 6, and the spring supporting parts 7 are provided on one of the main frame 2 and the medium holder cover 4. The print head 8, the platen roller receiving part 9, and the spring receiving part 10 are provided on the other one of the main frame 2 and the medium holder cover 4. When the medium holder cover 4 is closed relative to the main frame 2, the spring receiving part 10 comes into contact with the platen roller fixing springs 6, so that the platen roller fixing springs 6 press the platen roller 5 against the platen roller receiving part 9.

Figure 3:
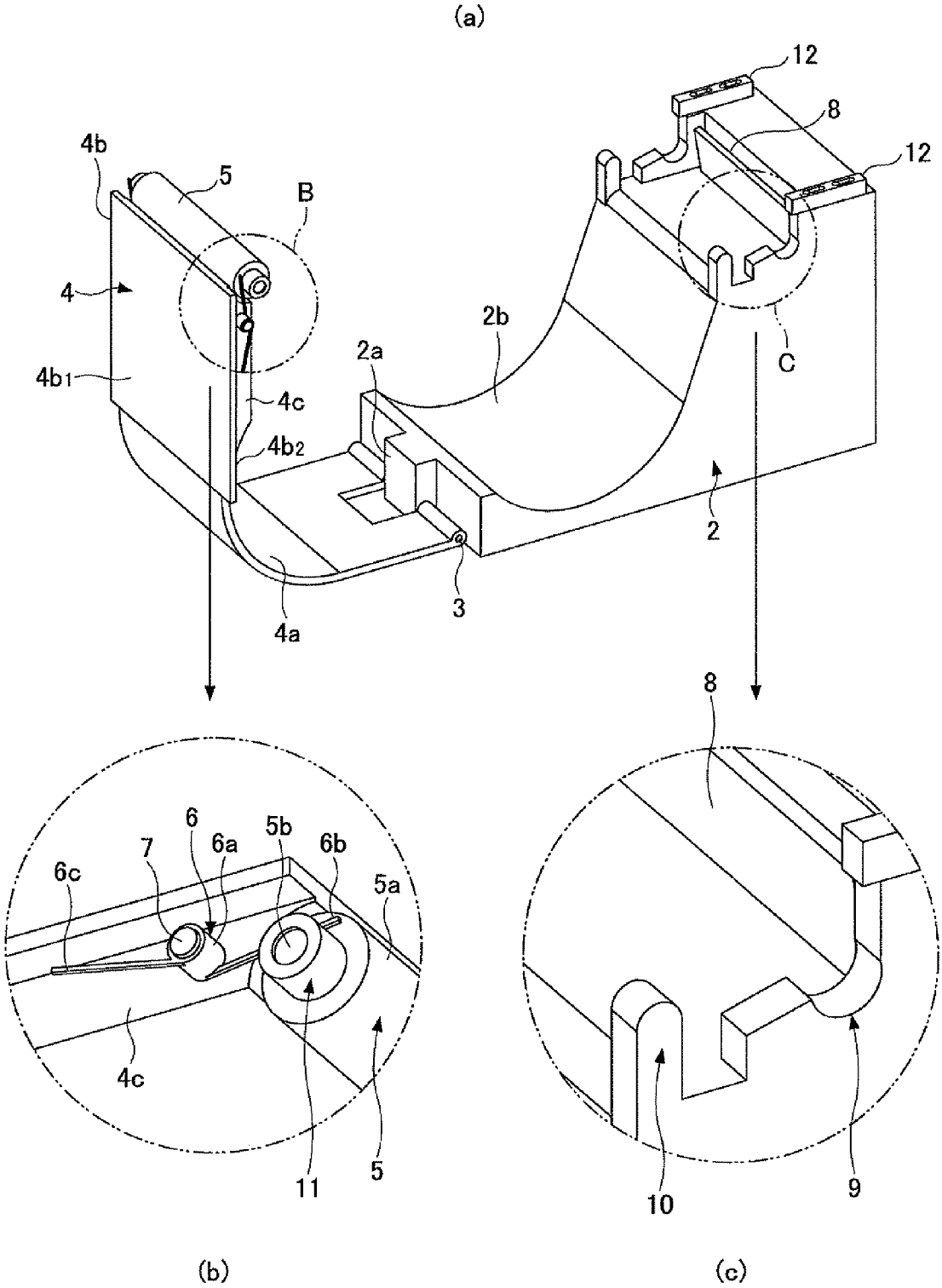
FIG. 3 is a schematic diagram illustrating the platen roller fixing structure and the printer in an open state according to the embodiment.

Referring to FIG. 3 as well, the main frame 2 includes a hinge receiving part 2*a* to which the hinge 3 is connected, a partially arc-shaped supporting part 2*b* positioned across the hinge receiving part 2*a* from the hinge 3, and the spring receiving part 10 and the platen roller receiving part 9, which are positioned across the partially arc-shaped supporting part 2*b* from the hinge 3. The partially arc-shaped supporting part 2*b* accommodates and supports a printing medium such as a roll R of printing paper P.

The medium holder cover 4 has an L-letter plate shape including a partially arc-shaped part 4*a* configured to accommodate the roll R of the printing paper P and a flat plate part 4*b* including the platen roller 5 and the platen roller fixing springs 6. The medium holder cover 4 is rotatably connected to the main frame 2 with the hinge 3.

The platen roller 5 is disposed at the outer end of the flat plate part 4*b* of the medium holder cover 4 in a radial direction relative to the rotation center. The medium holder cover 4 includes side plate parts 4*c* formed on a bottom (interior) surface 4*b*2 of the flat plate part 4*b* to extend in a direction perpendicular to the axial directions of the platen roller 5. The spring supporting parts 7 having a cylindrical shape such as a cylindrical dowel shape are formed on the respective side plate parts 4*c* to project in the axial directions of the platen roller 5. The platen roller fixing springs 6 are attached to these spring supporting parts 7.

The platen roller 5 includes a roller body part 5*a* and shaft parts 5*b* formed one at each end of the roller body part 5*a*. The shaft parts 5*b* are smaller in diameter than the roller body part 5*a*. The shaft parts 5*b* are inserted in respective platen roller bearings 11. The platen roller bearings 11 have their respective outer circumferential surfaces elastically supported on the medium holder cover 4 by a supporting mechanism (not graphically illustrated) so as to be displaceable in a direction toward and in a direction away from the bottom surface 4*b*2 of the flat plate part 4*b*.

The platen roller receiving part 9 has a partially cylindrical shape, corresponding to the outer circumferential surfaces of the platen roller bearings 11, in portions of the main frame 2 corresponding to the shaft parts 5*b* at the (axial) ends of the platen roller 5. In the state illustrated in FIG. 2, where the medium holder cover 4 is closed relative to the main frame 2, the spring supporting parts 7 are positioned on the hinge 3 side of the platen roller 5 (positioned closer to the hinge 3 than is the platen roller 5), and the spring receiving part 10 having a partially cylindrical surface and projecting toward the medium holder cover 4 is positioned on the hinge 3 side of the spring supporting parts 7 (positioned closer to the hinge 3 than are the spring supporting parts 7).

Each of the platen roller fixing springs 6 includes a spiral part 6*a* into which the corresponding spring supporting part 7 is inserted, a pressing arm part 6*b* projecting from the spiral part 6*a* in a direction away from the hinge 3, and a contact arm part 6*c* projecting from the spiral part 6*a* toward the hinge 3.

Although not graphically illustrated, the printer 1 of this embodiment may suitably include a fixed blade and a movable blade, which form a cutting part, and a drive mechanism configured to drive the fixed blade and the movable blade. A drive motor for driving the platen roller 5 is not graphically illustrated, either. FIG. 2 further omits graphical illustration of a drive gear 13 and a driven gear 14, of which a description is given below with reference to FIG. 5. Further, the printer 1 includes a platen roller fixing structure, which may be formed of components other than the main frame and the medium holder cover 4 of the printer 1.

FIG. 3 illustrates the printer 1 in an open state according to this embodiment. In FIG. 3, (a) is a schematic perspective view of the printer 1 in the open state, (b) is an enlarged view of part of the printer 1 encircled with a two-dot chain line B, and (c) is an enlarged view of part of the printer 1 encircled with a two-dot chain line C.

Referring to FIG. 3, in this open state, the contact arms 6*c* of the platen roller fixing springs 6 are out of contact with the spring receiving part 10 provided in the main frame 2 to remain free. Therefore, the pressing arm parts 6*b* of the platen roller fixing springs 6 exert no pressing force against the outer circumferential surfaces of the corresponding platen roller bearings 11 at the (axial) ends of the platen roller 5.

Figure 4:
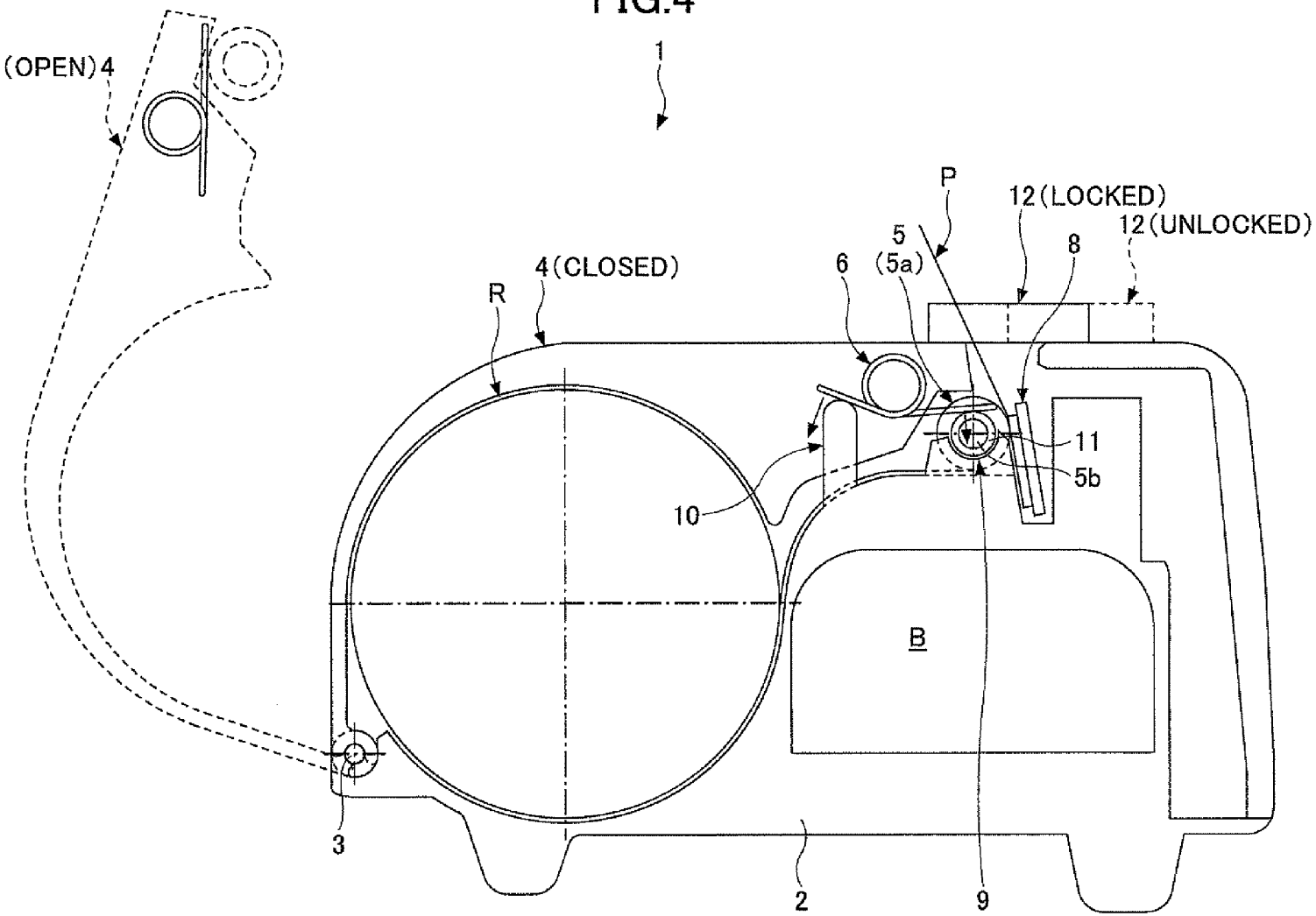
FIG. 4 a schematic diagram illustrating the platen roller fixing structure and the printer in a closed state according to the embodiment.

When the state of the printer 1 is switched from the open state illustrated in FIG. 3 to the closed state illustrated in FIG. 2, that is, when the medium holder cover 4 is moved from the position indicated by a broken line to the position indicated by a solid line in FIG. 4, the contact arm parts 6*c* of the platen roller fixing springs 6 come into contact with the partially cylindrical surface of the spring receiving part 10, so that the movements of the platen roller fixing springs 6 around the spring supporting parts 7 are restricted. As a result, an elastic force is accumulated in each of the platen roller fixing springs 6, and the accumulated elastic forces are input (applied) to the outer circumferential surfaces of the platen roller bearings 11 by the pressing arm parts 6*b* in a direction from a top (exterior) surface 4*b*1 to the bottom surface 4*b*2 of the flat plate part 4*b* of the medium holder cover 4. Referring to FIG. 4, the printer 1 includes a battery B serving as a power supply for the printer 1.

This application of the elastic forces causes the platen roller bearings 11, positioned one at each end of the platen roller 5, to be housed in and held by the platen roller receiving part 9. As a result, the platen roller 5 is fixed to the platen roller receiving part 9, so that the platen roller 5 is so fixed as to satisfy a predetermined positional relationship with the print head 8, which performs printing on the printing paper P.

As illustrated in FIG. 4, the path of the printing paper P extends counterclockwise in a circumferential direction of the paper roll R to pass on the surface of the platen roller 5 on the main frame 2 side. Then, the path of the printing paper P extends between the print head 8 and the platen roller 5 to reach outside through an opening (not graphically illustrated) from the bottom surface 4*b*2 ((a) in FIG. 3) of the medium holder cover 4.

The printer 1 of this embodiment further includes a medium holder cover lock including a pair of lock members 12 having a rectangular parallelepiped shape. The medium holder cover lock serves as a closed state maintaining part configured to selectively maintain the closed state of the medium holder cover 4 (hold the medium holder cover 4 closed) relative to the main frame 2. Each of the lock members 12 includes a sliding mechanism including pins 12*a* projecting on the surface of the main frame 2 and slits 12*b* into which the pins 12*a* are inserted. When the lock members 12 are slid and pulled out toward the hinge 3 side, the lock members 12 hold the top surface 4*b*1 of the flat plate part 4*b*, so that the closed medium holder cover 4 is locked and prevented from being displaced to its open position (indicated by a broken line in FIG. 4).

Further, if it is selected (determined) that the closed state of the medium holder cover 4 is not to be maintained by the lock members 12, that is, if the lock members 12 are slid in a direction away from the hinge 3 and retracted, the medium holder cover 4, that is, a movable part, is switched semi-automatically from the closed state to the open state based on the elastic forces exerted on the spring receiving part 10 by the platen roller fixing springs 6.

That is, the lock on the top surface 4*b*1 of the flat plate part 4*b* of the medium holder cover 4 set by the lock members 12 is released. Therefore, with the points of contact of the contact arm parts 6*c* with the partial cylindrical surface of the spring receiving part 10 serving as a point of effort, the points of contact of the spiral parts 6*a* with the spring supporting parts 7 serving as a fulcrum, and the points of contact of the pressing arm parts 6*b* with the bottom surface 4*b*2 of the flat plate part 4*b* of the medium holder cover 4 serving as a point of load, the platen roller fixing springs 6 exert lever forces and also exert the accumulated elastic forces, so that the medium holder cover 4 is sprung up in a direction to shift from the closed state to the open state.

That is, according to the above-described printer 1 and the platen roller fixing structure included in the printer 1 of this embodiment, it is possible to press the platen roller 5 against the platen roller receiving part 9 with the platen roller fixing springs 6 only in the closed state (of the printer 1) or a state close to the closed state, and it is possible to prevent the platen roller 5 from being pressed against the platen roller receiving part 9 in a state other than the closed state or a state close to the closed state.

That is, compared with the conventional technique of using the L-shaped platen roller fixing spring 58 as illustrated in FIG. 1, there is no particular increase in the operating force in the closing operation from the open state to the closed state. Therefore, it is possible to improve operability.

Further, the printer 1 includes the medium holder cover lock (lock members 12). This makes it easier to maintain the closed state of the printer 1 after the medium holder cover 4 is once closed relative to the main frame 2. Further, the closed printer 1 may be opened with more ease by sliding the lock members 12 in a direction away from the hinge 3.

Further, it is possible to improve operability in the closing operation and to improve operability in the opening operation with the same configuration defined by, for example, the platen roller fixing springs 6, the spring supporting parts 7, and the spring receiving part 10. This makes it possible to reduce the number of components as well.

Figure 5:
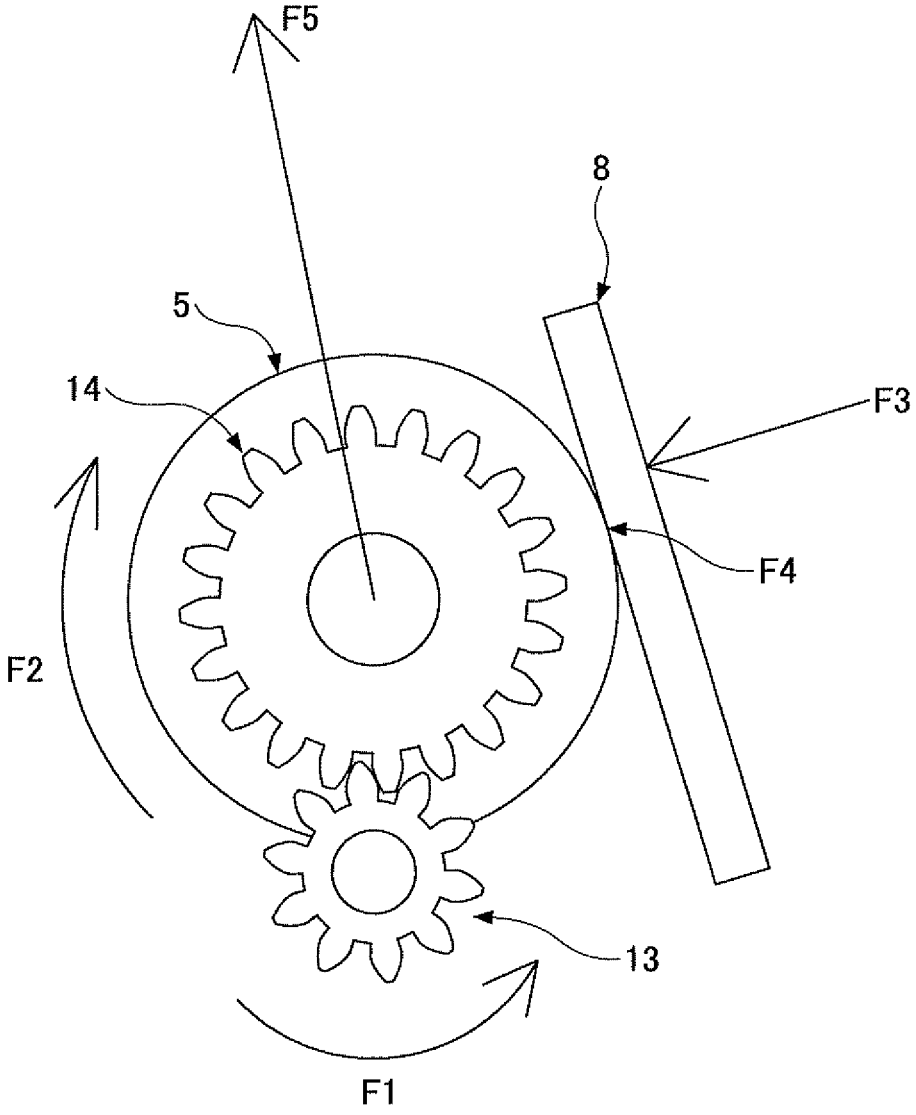
FIG. 5 is a schematic diagram illustrating the interrelationship between a drive force, a pressing force, a frictional force, and a reaction force exerted in the platen roller fixing structure and the printer according to the embodiment.

In addition, according to the printer 1 of this embodiment, as illustrated in FIG. 5, it is possible to cause the elastic forces of the platen roller fixing springs 6 to be exerted, based on the contact of the pressing arm parts 6*b* with the platen roller bearings 11, in a direction to substantially directly oppose a resultant acting force F5 of a drive torque F1 of the drive gear 13 that drives the platen roller 5, a transmitted torque F2 transmitted to the driven gear 14, a head pressure F3 generated by the contact of the print head 8 and the platen roller 5, and a frictional force F4 generated by the friction between the print head 8 and the platen roller 5. Therefore, it is possible to more effectively suppress the resultant force F5 caused by a printing operation and a winding-up operation in the printer 1 and thereby to make the printing operation and the winding-up operation more stable.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

For example, in the printer 1 of the above-described embodiment, the print head 8, the spring receiving part 10, and the platen receiving part 9 are provided in the main frame 2, while the platen roller 5, the platen roller fixing springs 6, and the spring supporting parts 7 are provided on the medium holder cover 4. This relative positional relationship, however, may be reversed.

Figure 6:
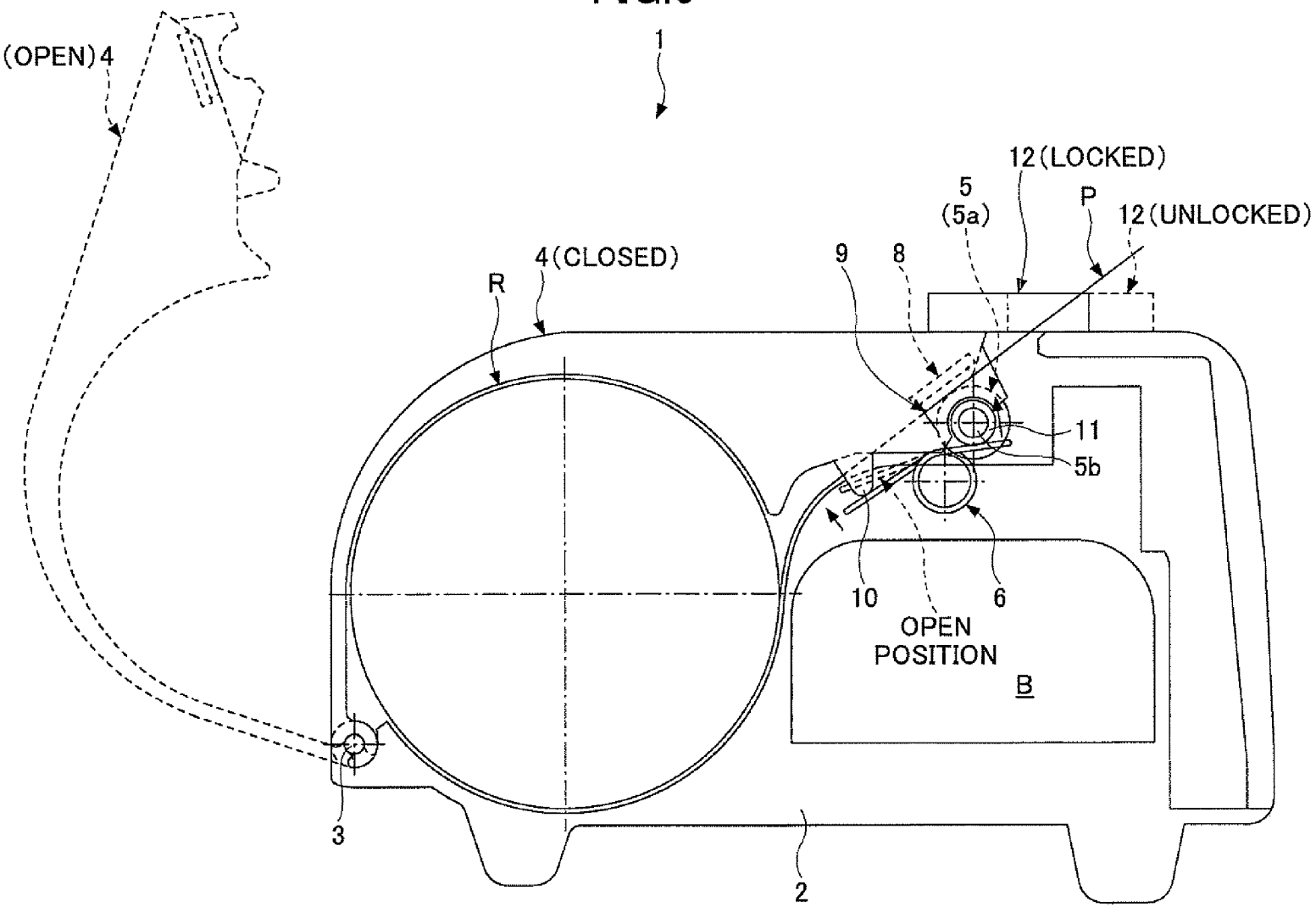
FIG. 6 is a schematic diagram illustrating another configuration of the platen roller fixing structure and the printer according to the embodiment.

FIG. 6 is a diagram illustrating another configuration of the printer 1 according to this embodiment.

As illustrated in FIG. 6, the print head 8, the spring receiving part 10, and the platen receiving part 9 may be provided on the medium holder cover 4, and the platen roller 5, the platen roller fixing springs 6, and the spring supporting parts 7 may be provided in the main frame 2. In this case, in addition to the above-described effects, it is also possible to provide the function of pressing the platen roller 5 against the print head 8 with the platen roller fixing springs 6. Further, this configuration allows the direction of the path of the printing paper P pulled out from the paper roll R to coincide with the plane direction of the print head 8. Therefore, this configuration is suitably applied to a case where the paper roll R is relatively thick.

Further, the platen roller fixing springs 6 are not limited in form to a toggle spring as illustrated in the embodiment and may have any form as long as the form includes a pressing arm part and a contact arm part and has the same fulcrum function as the spiral part 6*a*. For example, a wire spring or a leaf spring having an eye part or a circular hole part in place of the spiral part 6*a* may be used. In this case, an end portion extending from the eye part or the circular hole part in a direction away from the hinge 3 may serve as a pressing arm part, and an end portion extending from the eye part or the circular hole part in a direction toward the hinge 3 may serve as a contact arm part. With respect to material, the platen roller fixing springs 6 may be formed of a metal or resin. Further, the platen roller fixing spring 6 does not have to be provided on each side of the medium holder cover 4, and may be provided on only one side of the medium holder cover 4 in accordance with a fixing force required.

According to embodiments of the present invention, which are related to printers, it is possible to provide a platen roller fixing structure and a printer that make it possible to increase a force for fixing a platen roller without reducing closing-time operability. Therefore, embodiments of the present invention are applied to various types of printers, including a printer that feeds a belt-shaped printing medium, performs printing on the printing medium, and cuts the printing medium after printing, to advantage.

What is claimed is:

1. A platen roller fixing structure, comprising:

a platen roller;

a spring;

a spring supporting part supporting the spring;

a print head;

a platen roller receiving part configured to receive the platen roller; and a spring receiving part configured to receive the spring, wherein the platen roller, the spring, and the spring supporting part are provided on one of a body part and a movable part of a printer, the movable part being rotatably connected to the body part, the print head, the platen roller receiving part, and the spring receiving part are provided on another one of the body part and the movable part, and when the movable part is closed relative to the body part, the spring receiving part comes into contact with the spring to cause the spring to press the platen roller against the platen roller receiving part.

2. The platen roller fixing structure as claimed in claim 1, further comprising:

a closed state maintaining part configured to selectively maintain a closed state of the movable part relative to the body part.

3. The platen roller fixing structure as claimed in claim 2, wherein the movable part is caused to shift from the closed state to an open state based on an elastic force exerted on the spring receiving part by the spring in response to determining against maintaining the closed state of the movable part relative to the body part by the closed state maintaining part.

4. The platen roller fixing structure as claimed in claim 3, wherein the closed state maintaining part is configured to be slid back to the body part to unlock the movable part relative to the body part so as to allow an elastic force accumulated in the spring to cause the movable part to shift from the closed state to an open state.

5. The platen roller fixing structure as claimed in claim 2, wherein the closed state maintaining part is provided on the body part and configured to be slid onto a surface of the movable part to lock the movable part relative to the body part.

6. The platen roller fixing structure as claimed in claim 1, wherein:

the spring includes a spiral part, and a first arm part and a second arm part projecting from the spiral part in opposite directions, and when the movable part is closed relative to the body part, the spring receiving part comes into contact with the first arm part of the spring to cause the second arm part of the spring to press the platen roller against the platen roller receiving part.

7. The platen roller fixing structure as claimed in claim 6, wherein when the movable part is closed relative to the body part, the spring receiving part comes into contact with the first arm part of the spring to cause the second arm part of the spring to press a platen roller bearing at an axial end of the platen roller against the platen roller receiving part.

8. The platen roller fixing structure as claimed in claim 6, wherein:

the spring supporting part has a cylindrical shape, and the spring supporting part is inserted in the spiral part of the spring so that the spring is movably supported by the spring supporting part.

9. The platen roller fixing structure as claimed in claim 8, wherein:

the spring receiving part projects from the other one of the body part and the movable part and has a partially cylindrical surface, and when the movable part is closed relative to the body part, the partially cylindrical surface of the spring receiving part comes into contact with the first arm part of the spring to restrict a movement of the spring around the spring supporting part.

10. A printer, comprising:

a body part;

a movable part rotatably connected to the body part; and a platen roller fixing structure, the platen roller fixing structure including a platen roller;

a spring;

a spring supporting part supporting the spring;

a print head;

a platen roller receiving part configured to receive the platen roller; and a spring receiving part configured to receive the spring, wherein the platen roller, the spring, and the spring supporting part are provided on one of the body part and the movable part, the print head, the platen roller receiving part, and the spring receiving part are provided on another one of the body part and the movable part, and when the movable part is closed relative to the body part, the spring receiving part comes into contact with the spring to cause the spring to press the platen roller against the platen roller receiving part.

* * * * *

UNITED STATES PATENT AND TRADEMARK OFFICE

CERTIFICATE OF CORRECTION

PATENT NO. : 8,672,569 B2
APPLICATION NO. : 13/437078
DATED : March 18, 2014
INVENTOR(S) : Yuji Yada et al.

It is certified that error appears in the above-identified patent and that said Letters Patent is hereby corrected as shown below:

On the title page correct the Item (73): Assignee's name to "FUJITSU COMPONENT LIMITED" from "Fujitsu Components Limited".

Signed and Sealed this
Tenth Day of June, 2014

Michelle K. Lee

Michelle K. Lee
*Deputy Director of the United States Patent and Trademark Office*